US005289866A

United States Patent [19]

Parsley et al.

[11] Patent Number: 5,289,866

[45] Date of Patent: Mar. 1, 1994

[54] PISTON MOLD

[75] Inventors: Clovis L. Parsley, Bedford; Roland M. Preiser, Bloomington, both of Ind.

[73] Assignee: General Motors Corporation, Detroit, Mich.

[21] Appl. No.: 997,046

[22] Filed: Dec. 28, 1992

[51] Int. Cl.[5] ..... B22D 15/02; B22D 33/04

[52] U.S. Cl. ..... 164/340; 164/341; 164/342; 249/161

[58] Field of Search ..... 164/339, 340, 341, 342, 164/343, DIG. 8, 137; 249/161, 162

[56] References Cited

U.S. PATENT DOCUMENTS 2,233,057 2/1941 Luce .
2,527,537 10/1950 Fahlman et al. ..... 164/340 X
2,711,568 6/1955 Palmer et al. ..... 164/340
2,780,849 2/1957 Berry ..... 164/340
3,283,374 11/1966 Péras ..... 164/340
3,643,732 2/1972 Carlsen ..... 164/309
4,049,040 9/1977 Lynch ..... 164/120
4,449,567 5/1984 Blazek et al. ..... 164/137
4,757,857 7/1988 Henkel ..... 164/137
5,074,352 12/1991 Suzuki ..... 164/97

*Primary Examiner*—J. Reed Batten, Jr.
*Attorney, Agent, or Firm*—Lawrence B. Plant

[57] ABSTRACT

A piston casting mold for casting all pistons in a single series with little weight variation one from the next, includes spacers of fixed dimensions are employed to locate a dome-forming core of the mold a fixed distance from a stationary portion of the mold from one casting to the next. Increasing or decreasing the dimensions of the spacer permits increasing or decreasing the as-cast weight of the piston.

13 Claims, 2 Drawing Sheets

PISTON MOLD

This invention relates to a permanent mold for gravity casting pistons for internal combustion engines, and more particularly to a mold which casts a series of such pistons with little weight variation from one piston to the next in that series, and which is readily converted to casting pistons having a different weight in a different series of castings.

BACKGROUND OF THE INVENTION

An internal combustion engine requires that all of its pistons have substantially the same weight. That is to say, that the variation in weight from one piston to the next is less than 0.8%. Hence, for example, engines having pistons weighing about 500 grams will typically require that there be no more than 4 grams weight difference from one piston to the next.

Owing in part to significant variations in the as-cast weight of pistons leaving conventional piston molds, it has heretofore been common practice in the industry to cast extra metal onto the piston in a region thereof known as a "balance pad". The balance pad often contains as much as 20–25 grams of extra metal much of which is subsequently machined away in a weight-control station located downstream of the casting operation where the weight of the piston is brought within acceptable limits. The weight-control operation involves weighing of the piston before removing metal from the balance pad, machining metal from the balance pad and then re-weighing the piston to check its final weight. This weight control procedure is time consuming and costly and, if eliminated, would improve the productivity of the piston manufacturing operation and reduce the cost of pistons produced thereby.

It would be desirable to eliminate the machining for weight control step and shift the weight control to the casting station if possible. Heretofore that has not been possible. One of the reasons for significant as-cast weight variations is the design of the mold used to shape the piston. Heretofore the mold design, the tolerances between the several movable mold components, and the stack up of those components has allowed for wide weight variations from one piston to the next all cast from the same mold. In this regard heretofore, the core forming the firing face of the piston (hereafter dome) typically located against a surface or surfaces on the mold segments which shape the sidewalls of the piston, which, in turn, is located against a stationary mold part. Since the several mold parts each has its own manufacturing tolerance and allowances for clearances within the mold, the stack up of the mold components from one casting to the next allowed for wide variations of spacing between the core used to shape the piston's firing face and the stationary base of the mold. This type of location system simply does not control the location of the dome-forming core accurately enough to control piston weight. Some clearances must be provided between the several components of the mold and these clearances reveal themselves as locational error of the dome core relative to the piston interior as the molds' sidewall segments randomly move up and down in this clearance. Hence, each time the several mold components came together to form the mold cavity, the components are positioned in a slightly different position from the previous casting. This particularly affects the location of the dome-forming core relative to the stationary base of the mold.

It is an object of the present invention to provide a permanent mold for the gravity casting of internal combustion engine pistons which mold (1) produces a series of cast pistons having little weight variation from one piston to the next, (2) can be readily converted to cast a different series of pistons having a different weight than the previous series of pistons, and (3) obviates the need for a downstream station for machining the piston to adjust its weight. It is a further object of the present invention to provide a permanent mold for the gravity casting of pistons wherein spacer means are provided between a dome-forming core and a stationary base component of the mold to establish a fixed distance therebetween from one casting to the next and thereby insure that all of the pistons cast from that mold using the spacer have substantially the same weight. This and other objects and advantages of the present invention will become more readily apparent from the detailed description thereof which follows.

SUMMARY OF THE INVENTION

In accordance with the present invention, a spacer of controlled dimension is provided to locate the dome-forming core a controlled distance from a stationary component of the mold (i.e., the mold base), which distance will not change from casting one piston to the next in a particular series of castings, and until such time as the spacer may be replaced with another spacer adapted to increase or decrease the desired weight of the piston. In this latter regard, a slightly longer spacer may be used to increase the distance between the dome-forming core and the mold base and thereby add weight to the piston, or a slightly shorter spacer may be used to decrease the distance between the dome-forming core and the mold base and thereby reduce the weight of the piston.

More specifically, the invention comprehends a permanent mold for sequentially casting a series of internal combustion engine pistons (e.g., out of aluminum) with little weight variation from one piston to the next in that series. The pistons each have a top wall, a firing face (a.k.a., dome) formed on the exterior surface of the top wall, and a side wall depending from the top wall and including a ring band portion adjacent the top wall and a skirt portion more remote from the top wall than the ring band portion. Appropriate grooves for receiving compression and oil rings are formed into the ring band portion when the pistons are machined. The mold itself comprises a stationary base, a first core movable to and fro within the base for shaping the interior of the piston, a set of mold segments movable laterally with respect to the first core so as to converge upon the first core during mold closing to define a mold cavity for forming the piston's side wall when the mold is fully closed and which diverge from the first core when the mold is opening to release the piston from the mold cavity. A second core is movable into axial alignment with, and opposing relation to, the first core when the mold is in the mold-closed position and serves to close off the mold cavity and shape the dome on the top wall of the piston. At least one (preferably four) spacer is provided which extends between the stationary base and the second core when the mold is in the mold-closed position to locate the second core a fixed distance from the base from one casting to the next which, in turn, serves to consistently mold one piston after the other with substantially same top wall thickness. This, in turn, substantially reduces any variation in piston weight from one piston to the next in a given series of pistons cast from the mold.

In the event it becomes necessary to change the weight of the pistons being cast, the spacer(s) will simply be replaced with another set of spacer(s) which are either slightly longer or slightly shorter than the original set so as to increase or decrease the piston weight respectively. This may be necessitated, for example, when different batches of metal having slightly different densities are used, or some other variable (e.g., thickness of the mold coating or wear of the mold components) in the casting operation changes and causes variations in the piston weight.

In accordance with a preferred embodiment of the present invention, the dome-forming core is pivotally connected to one of the laterally moving mold segments for arcuate movement into alignment with the first core in the mold-closed position. In this preferred embodiment, the laterally moving segments include through-holes which extend between the dome-forming core and the stationary base and the spacer(s) comprises a pin(s) extending through the through-holes so as to engage the dome-forming core and the base on opposite ends of the pins.

BRIEF DESCRIPTION OF THE DRAWINGS

The invention will better be understood when considered in the light of the following detailed description of a specific embodiment thereof which is provided hereafter in conjunction with the several figures in which.

DETAILED DESCRIPTION OF A SPECIFIC EMBODIMENT

Figure 1:
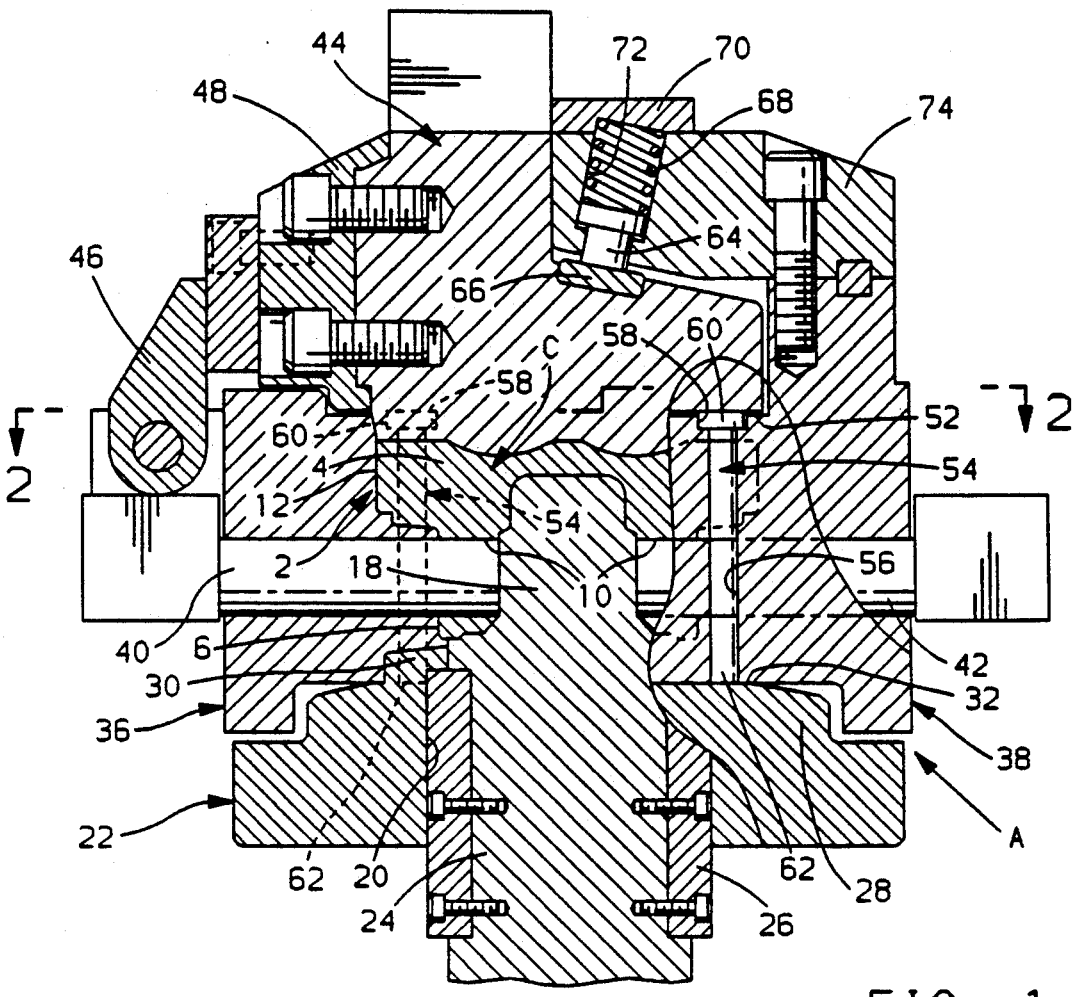
FIG. 1 is a side, sectioned view taken through the center of a piston mold in the mold-close position including a portion A taken at a different elevation to show the spacer in elevation.
Figure 2:
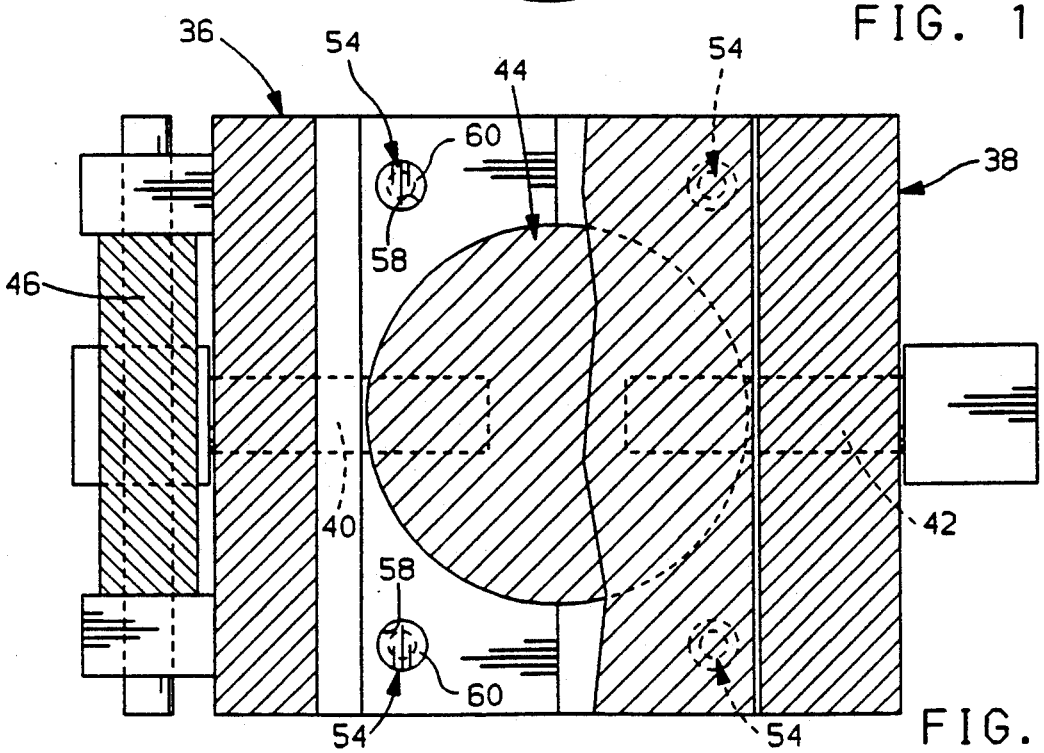
FIG. 2 is a view in the direction 2—2 of FIG. 1.

The figures show a piston 2 having a top wall 4 and a depending side wall 6 including a skirt portion 8. Wrist pin holes 10 are formed in the side wall 6 during the casting operation. The top wall 4 includes a dome 14 and is defined by a peripheral ring belt 12 portion of the side wall 6 into which compression and oil ring grooves are subsequently machined. A cavity or hollow 16 is formed in the center of the piston 2 by a first core 18 which reciprocates to and fro within an opening 20 in a stationary base ring of the mold 22. The core 18 is carried on a core shaft 24 which is sheathed with semi-circular wear plates 26 which slide against the interior surface of the opening 20.

The stationary base ring 22 includes a mesa 28 which, in turn, includes an upstanding plateau portion 30. A flat upper surface 32 atop the mesa 28 lies outboard the plateau 30 and provides a seat for the spacer pins (to be described hereinafter). A sloping surface 34 adjacent the top edge of the mesa 28 serves to guide the spacer pins into position on upper surface 32 as the mold closes.

Figure 3:
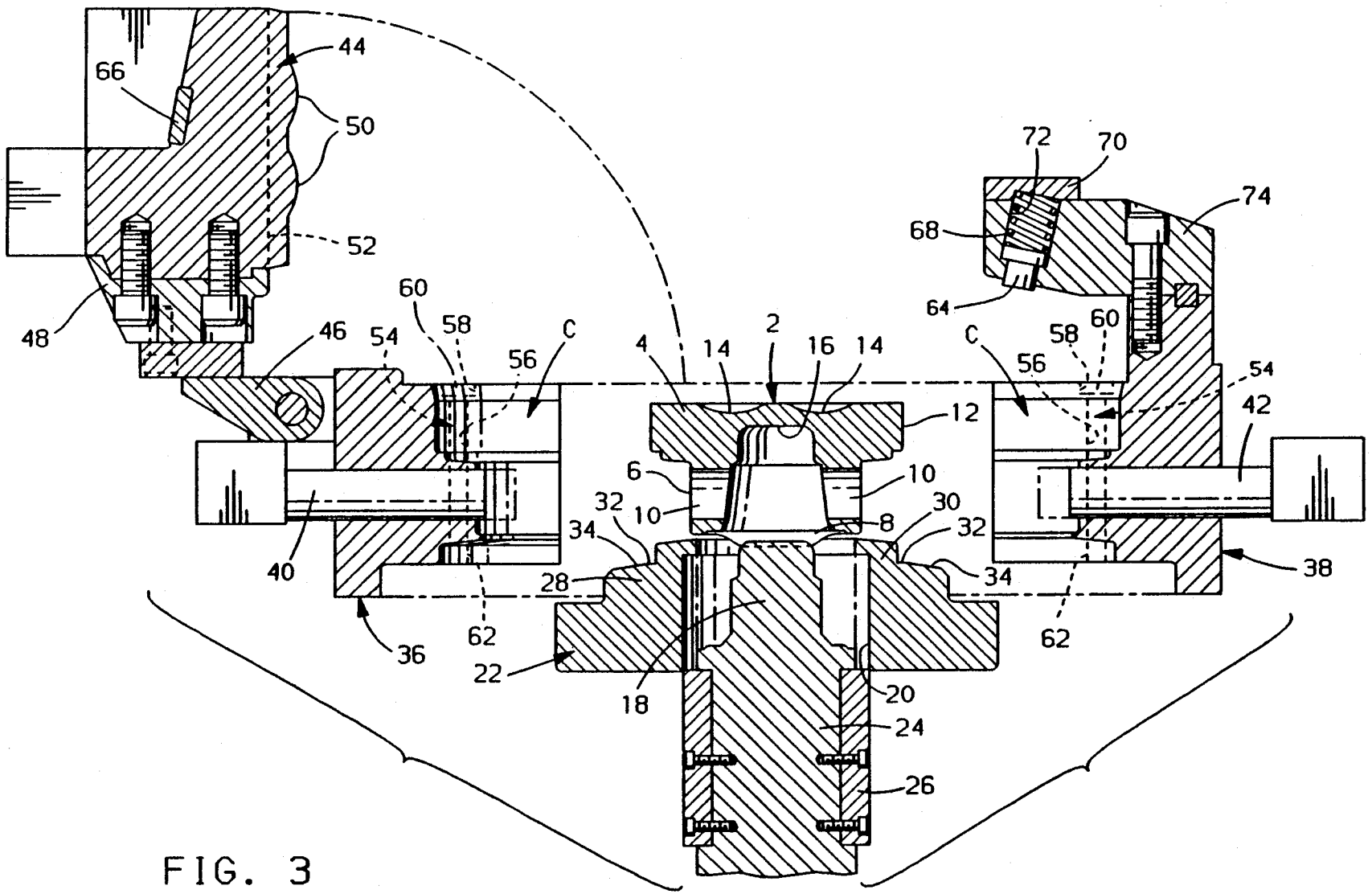
FIG. 3 is a view like that of FIG. 1, but with the mold in the mold-open position.

Mold segments (preferably halves) 36 and 38 converge radially (preferably diametrically) upon the core 18 during mold closing and diverge therefrom during mold opening to release the piston from the mold cavity C. The mold segments 36 and 38, along with the core 18, serve to define that portion of the mold cavity C which forms the side wall 6 including the ring belt 12 of the piston. The mold segments 36 and 38 also serve to carry wrist pin forming cores 40 and 42 which reciprocate with respect to their respective mold segments 36 and 38 to form the wrist pin openings 10. As best shown in FIG. 1, the wrist pin forming cores 40 and 42 extend into the mold cavity C when the mold is in the mold-closed position (see FIG. 1), and as best shown in FIG. 3, are retracted when the mold is in the mold-open position.

A core 44 is pivotally connected to mold segment 36 via the hinge member 46 and associated fastening means 48. The core 44 has a molding face 50 which serves to shape the dome 14 in the top wall 4 of the piston 2. In the mold-closed position, the core 44 pivots down into axial alignment with the first core 18 to close off the mold cavity C. The core 44 has surfaces 52 thereon (see FIG. 1) adapted to engage the upper end of spacer pins 54, which extend through through-holes 56 in the mold segments 36 and 38. The upper ends 58 of the through-holes 56 are larger than the remainder of the through-holes 56 and are adapted to receive a head portion 60 on the upper end of the spacer pin 54 to prevent the pin 54 from falling out of the through-holes 56 when the mold is in the mold open position. In the mold-closed position, the upper end 60 of the spacer pins 54 directly engage the upper surface 52 of the core 44 while the other end 62 of the pin 54 engages the surface 32 of the base 22 thereby locating the core 44 a fixed distance from the base 22, which distance will be constant from one piston to the next while casting in a given series of pistons, regardless of the manufacturing tolerances of the mold segments 36 and 38, the base 22, the core 44 or clearances therebetween. The net effect of locating the core 44 a fixed distance from the base 22 is to consistently provide pistons 2 with upper walls 4 which are consistently the same thickness, and correspondingly pistons which are consistently about the same weight.

If for some reason it is desirable to increase the as-cast weight of the piston 2 it is a simple matter to replace the spacer pins 54 with slightly longer pins to slightly increase the distance of the core 44 from the base 22. Similarly if for some reason it is desirable to reduce the weight of the piston in the as-cast condition, it is a simple matter to replace the pins 54 with slightly shorter pins 54.

In the mold-closed position, the dome-forming core 44 is held tightly in position by a piston 64 which presses against a pad 66 on the backside of the core 44. The piston 64 is biased against the pad 66 by a compression spring 68 held in place in a bore 72 by anchoring plates 70. The spring 68 and piston 64 are movable in bore 72 formed in the overhang portion 74 of the mold segment 38 opposite the hinge-bearing mold segment 36.

While the invention has been disclosed primarily in terms of a specific embodiment thereof it is not intended to be limited thereto, but rather only to the extent set forth hereafter in the claims which follow.

The embodiments of the invention in which an exclusive property or privilege is claimed are defined as follows:

1. A permanent mold for sequentially casting a series of IC-engine pistons with little weight variation from one piston to the next in said series, said pistons each having a top wall and a sidewall depending from said top wall, said mold comprising:

(1) a stationary base;

(2) a first core moveable to and from within said base from a first mold-closed position for shaping the interior of a piston and a second mold-open position for releasing said piston from said mold;

(3) a set of mold segments moveable with respect to said first core so as to converge upon said first core and engage said base in the mold-closed position to define a mold cavity for shaping said sidewall and to diverge from said first core to release said piston from said cavity in the mold-open position; and (4) a second core moveable into axial alignment with, and opposing relation to, said first core when said mold is in the mold-closed position for closing off said cavity and shaping a firing face on said top wall of said piston; and (5) spacer means extending between said base and said second core in the position to space said second core a fixed distance from said base so as to consistently cast pistons having substantially the same top wall thickness from one piston to the next.

2. A mold according to claim 1 wherein said spacer means is interchangeable with other spacer means for changing the thickness of the top wall from one series of pistons to the next.

3. A permanent mold for sequentially casting a series of IC-engine pistons with little weight variation from one piston to the next in said series, said pistons each having a top wall and a side wall depending from said top wall, said mold comprising:

(1) a stationary base;

(2) a first core moveable to and fro within said base from a first mold-closed position for shaping the interior of a piston and a second mold-open position for releasing said piston from said mold;

(3) a set of mold segments radially moveable with respect to said first core so as to converge upon said first core and engage said base in the mold-closed position to define a mold cavity for shaping said sidewall and to diverge from said first core to release said piston from said cavity in the mold-open position; and (4) a second core pivotally connected to a first of said mold segments for arcuate movement into axial alignment with, and opposing relation to, said first core when said mold is in the mold-closed position for closing off said cavity and shaping the firing face of said top wall;

(5) through hole means in said segments extending between said second core and base when said mold is in the mold-closed position; and (6) spacer means extending through said through hole means, said spacer means having a first end engaging said base and a second end engaging said second core when said mold is in the mold-closed position, said spacer means serving to space said second core a fixed distance from said base so as to consistently cast pistons having substantially the same top wall thickness from one piston to the next.

4. The mold according to claim 3 wherein said spacer means comprises at least one pin.

5. The mold according to claim 4 wherein said spacer means comprises a plurality of pins positioned radially outboard said first core.

6. The mold according to claim 3 wherein said set comprises a pair of mold halves.

7. The mold according to claim 6, wherein a pair of said spacer means extends through each of said mold halves.

8. The mold according to claim 3 wherein said base has a seat portion engaging said first end of said spacer means and ramp means radially outboard said seat portion for engaging a said first end during mold closure to guide said first end onto said seat portion.

9. The mold according to claim 3 wherein each of the mold segments includes a reciprocating core pin which extends into said cavity in the mold-closed position to form a wrist pin bore and retracts from said cavity in the mold-open position to release said piston from said mold.

10. The mold according to claim 3 including clamping means secured to a second of said segments for engaging said second core and pressing it firmly against said spacer means when said mold is in the mold-closed position so as to prevent displacement of said second core during the casting of said piston.

11. The mold according to claim 11 wherein said clamping means includes a spring-biased piston engaging said second core.

12. The mold according to claim 11 wherein said clamping means engages said second core adjacent the centerline of said first and second core.

13. The mold according to claim 3 wherein said spacer means is interchangeable with longer or shorter spacer means for changing the thickness of the top wall from one series of pistons to the next.

* * * * *